US009451836B2

(12) United States Patent
Szpak et al.

(10) Patent No.: US 9,451,836 B2
(45) Date of Patent: Sep. 27, 2016

(54) SLIDING AND PIVOTING RETAINER

(71) Applicants: Gerald Matthew Szpak, Brecksville, OH (US); Gregory M. Bird, Solon, OH (US); Shane Obitts, Elyria, OH (US); Matthew Grubbs, Union, KY (US); Robert Govia, Cuyahoga Falls, OH (US); James J. Kopco, Mentor-on-the-Lake, OH (US)

(72) Inventors: Gerald Matthew Szpak, Brecksville, OH (US); Gregory M. Bird, Solon, OH (US); Shane Obitts, Elyria, OH (US); Matthew Grubbs, Union, KY (US); Robert Govia, Cuyahoga Falls, OH (US); James J. Kopco, Mentor-on-the-Lake, OH (US)

(73) Assignee: Fasteners For Retail, Inc., Twinsburg, OH (US)

( * ) Notice: Subject to any disclaimer, the term of this patent is extended or adjusted under 35 U.S.C. 154(b) by 0 days.

(21) Appl. No.: 13/957,962

(22) Filed: Aug. 2, 2013

(65) Prior Publication Data

US 2014/0034590 A1 Feb. 6, 2014

Related U.S. Application Data

(60) Provisional application No. 61/679,419, filed on Aug. 3, 2012, provisional application No. 61/808,000, filed on Apr. 3, 2013.

(51) Int. Cl.

| | |
|---|---|
| ***A47F 1/04*** | (2006.01) |
| ***A47F 7/00*** | (2006.01) |
| ***A47F 1/12*** | (2006.01) |
| ***A47F 5/00*** | (2006.01) |

(52) U.S. Cl.

CPC . *A47F 1/04* (2013.01); *A47F 1/12* (2013.01); *A47F 5/005* (2013.01)

(58) Field of Classification Search

CPC ..... A47F 1/12; A47F 1/126; A47F 5/0093; A47F 5/005; A47B 96/027; A47B 96/28

See application file for complete search history.

(56) References Cited

U.S. PATENT DOCUMENTS

| | | | |
|---|---|---|---|
| 1,877,050 | A | 9/1932 | Ray |
| 2,446,788 | A | 8/1948 | Rifkin |
| 2,460,396 | A | 2/1949 | Rifkin |
| 2,480,339 | A | 8/1949 | Rifkin |

(Continued)

FOREIGN PATENT DOCUMENTS

| | | | |
|---|---|---|---|
| CA | 2 725 928 | A1 | 6/2011 |
| EP | 0 004 921 | A1 | 10/1979 |
| EP | 0 568 396 | A1 | 11/1993 |

OTHER PUBLICATIONS

FFR-DSI Yellow Pages 2010 Product Catalog, cover page, pp. 231, 241, and 246.

*Primary Examiner* — Joshua Rodden
*Assistant Examiner* — Kimberly S Wright
(74) *Attorney, Agent, or Firm* — Fay Sharpe LLP

(57) ABSTRACT

A merchandising security system includes a support adapted to be secured to a first associated merchandising structure and at least one product barrier movably mounted to the support. The at least one product barrier extends away from the support so as to approach a second associated merchandising structure spaced from the first associated merchandising structure. The product barrier is at least one of slidably mounted in relation to the support and pivotably mounted in relation to the support, wherein the product barrier includes first and second members which cooperate to retard a forward movement of an associated object supported on the first associated merchandising structure. At least one of the first and second members is mounted in relation to the support via a hinge.

20 Claims, 17 Drawing Sheets

(56) References Cited

U.S. PATENT DOCUMENTS

| | | | | | |
|---|---|---|---|---|---|
| 2,522,896 | A | | 9/1950 | Rifkin | |
| 3,018,900 | A | * | 1/1962 | Huet | 211/193 |
| 3,463,433 | A | * | 8/1969 | Coe et al. | 248/242 |
| 3,923,159 | A | | 12/1975 | Taylor et al. | |
| 4,098,480 | A | * | 7/1978 | Neumann | 248/243 |
| 4,610,491 | A | * | 9/1986 | Freeman | 312/291 |
| 4,620,489 | A | * | 11/1986 | Albano | 108/105 |
| 4,640,560 | A | | 2/1987 | Blum | |
| 4,646,658 | A | * | 3/1987 | Lee | 108/143 |
| 4,682,825 | A | * | 7/1987 | Crosslen | 312/42 |
| 4,717,112 | A | * | 1/1988 | Pirkle | 248/639 |
| 4,934,645 | A | * | 6/1990 | Breslow | 248/242 |
| 5,390,802 | A | * | 2/1995 | Pappagallo et al. | 211/59.3 |
| 5,417,333 | A | | 5/1995 | Flum | |
| 5,449,076 | A | * | 9/1995 | Van Noord | 211/59.3 |
| 5,531,159 | A | * | 7/1996 | Stubblefield | 108/102 |
| 5,542,552 | A | | 8/1996 | Yablans et al. | |
| 5,715,957 | A | * | 2/1998 | Merl | 211/187 |
| 5,720,230 | A | * | 2/1998 | Mansfield | 108/108 |
| 5,738,019 | A | * | 4/1998 | Parker | 108/108 |
| 5,806,689 | A | | 9/1998 | Mays et al. | |
| 5,924,367 | A | * | 7/1999 | Henke et al. | 108/108 |
| 5,970,887 | A | * | 10/1999 | Hardy | 108/108 |
| 6,095,347 | A | * | 8/2000 | Mauro-Vetter | 211/151 |
| 6,123,303 | A | * | 9/2000 | Huang | 248/241 |
| 6,142,317 | A | | 11/2000 | Merl | |
| 6,164,462 | A | * | 12/2000 | Mumford | 211/59.2 |
| 6,253,954 | B1 | | 7/2001 | Yasaka | |
| 6,302,282 | B1 | * | 10/2001 | Gay et al. | 211/153 |
| 6,357,609 | B1 | * | 3/2002 | Van Noord et al. | 211/90.02 |
| 6,428,123 | B1 | | 8/2002 | Lucht et al. | |
| 6,513,667 | B2 | | 2/2003 | Battaglia et al. | |
| 6,726,040 | B1 | * | 4/2004 | Chen | 211/187 |
| 6,799,523 | B1 | * | 10/2004 | Cunha | 108/108 |
| 6,976,598 | B2 | * | 12/2005 | Engel | 211/187 |
| 7,032,761 | B2 | * | 4/2006 | Nagel | 211/59.3 |
| 7,124,898 | B2 | | 10/2006 | Richter et al. | |
| 7,150,365 | B2 | | 12/2006 | Hardy et al. | |
| 7,641,072 | B1 | | 1/2010 | Vlastakis et al. | |
| 7,665,618 | B2 | * | 2/2010 | Jay et al. | 211/59.2 |
| 7,690,519 | B2 | | 4/2010 | Kahl et al. | |
| 7,823,734 | B2 | | 11/2010 | Hardy | |
| 7,854,333 | B2 | * | 12/2010 | Kottke et al. | 211/59.2 |
| 8,056,734 | B2 | | 11/2011 | Menz et al. | |
| 8,152,006 | B2 | | 4/2012 | Wamsley et al. | |
| 8,167,149 | B2 | * | 5/2012 | Wamsley et al. | 211/119.003 |
| 8,397,922 | B2 | * | 3/2013 | Kahl et al. | 211/59.2 |
| 8,469,205 | B1 | | 6/2013 | Hardy | |
| 8,622,227 | B2 | * | 1/2014 | Bird et al. | 211/119.003 |
| 2002/0027115 | A1 | * | 3/2002 | Gay et al. | 211/187 |
| 2003/0066811 | A1 | * | 4/2003 | Dimattio et al. | 211/59.2 |
| 2003/0160012 | A1 | * | 8/2003 | Kanouchi et al. | 211/59.2 |
| 2004/0140279 | A1 | | 7/2004 | Mueller et al. | |
| 2006/0196840 | A1 | * | 9/2006 | Jay et al. | 211/59.2 |
| 2006/0207950 | A1 | | 9/2006 | Kiehnau et al. | |
| 2006/0238082 | A1 | * | 10/2006 | Heidemann et al. | 312/131 |
| 2007/0170127 | A1 | | 7/2007 | Johnson | |
| 2008/0011696 | A1 | * | 1/2008 | Richter et al. | 211/59.2 |
| 2008/0035589 | A1 | * | 2/2008 | Rasmussen et al. | 211/59.3 |
| 2009/0223914 | A1 | * | 9/2009 | Kahl et al. | 211/59.2 |
| 2011/0220593 | A1 | * | 9/2011 | Wamsley et al. | 211/4 |
| 2011/0290749 | A1 | * | 12/2011 | Neumann et al. | 211/59.2 |
| 2012/0103922 | A1 | | 5/2012 | Bird et al. | |
| 2012/0285906 | A1 | * | 11/2012 | Bird et al. | 211/4 |
| 2013/0146552 | A1 | * | 6/2013 | Grimes | 211/126.15 |
| 2013/0213906 | A9 | * | 8/2013 | Bird et al. | 211/4 |
| 2014/0034591 | A1 | * | 2/2014 | Szpak et al. | 211/59.2 |
| 2014/0263112 | A1 | * | 9/2014 | Bird et al. | 211/59.2 |
| 2014/0299559 | A1 | * | 10/2014 | Bird et al. | 211/59.2 |

* cited by examiner

SLIDING AND PIVOTING RETAINER

The instant application is a full utility application of and claims priority from U.S. Provisional Application Ser. No. 61/679,419 which was filed on Aug. 3, 2012 and from U.S. Provisional Application Ser. No. 61/808,000 which was filed on Apr. 3, 2013. Both of these applications are incorporated by reference in their entireties.

BACKGROUND

The present disclosure concerns a product dispensing system employed in point of sale merchandising. It particularly pertains to shelving systems which feed containers forward. More specifically, it relates to modular gravity fed shelving systems for containers and other like products. On example is a thin wall container of a refrigerated dairy product.

Many products of this type are available, including yogurt, cottage cheese, cream cheese, sour cream and the like. Such products are typically sold in individual cups or containers in supermarkets and the like. Dairy product containers of this kind normally have planar bases and planar tops so that they can be stacked atop each other. Traditionally, such dairy products are sold in refrigerator cases, including generally horizontal shelves upon which the dairy products are held.

Gravity feed systems are known to move products towards the front of display or storage cases. While it is now known to feed dairy products such as yogurt by gravity towards the front end of a refrigerated display case, the currently known retainers positioned at the front end of such display trays or shelves are not optimal. In addition, conventional display shelving systems require more vertical spacing between adjacent shelves in order to allow restocking of the dairy products on the shelves because of clearance issues. Specifically, the merchant cannot allow products on a shelf which is pulled out for restocking to contact the shelf immediately above it. This mandates a minimum shelf spacing in a storage case. It is a particular problem for slide out shelving which conventionally needs to be tilted as it is slid forward to the restocking position.

Further, current shelving designs do not allow for a secondary shelf to be placed atop the primary shelf to provide additional displays of product. Such a design is useful for providing more product selection without the need to replace the entire shelving system. It would also be desirable to provide a better locking system for pull out shelving to retain a slide out shelf in the use position. Thus, a need exists for a shelving system which overcomes the deficiencies of prior shelving systems as outlined above.

BRIEF DESCRIPTION OF THE DISCLOSURE

In one embodiment, the present disclosure pertains to a merchandising security system comprising a support adapted to be secured to a first associated merchandising structure and at least one product barrier movably mounted to the support. The at least one product barrier extends away from the support so as to approach a second associated merchandising structure spaced from the first associated merchandising structure. The product barrier is at least one of slidably mounted in relation to the support and pivotably mounted in relation to the support wherein the retainer comprises first and second members which cooperate to retard a forward movement of an associated object supported on the first associated merchandising structure. At least one of the first and second members is mounted in relation to the support via a hinge.

According to another embodiment of the present disclosure, there is provided a merchandising security system comprising a support adapted to be secured to a first associated merchandising structure and at least one product barrier movably mounted to the support. The at least one product barrier extends away from the support so as to approach a second associated merchandising structure spaced from the first associated merchandising structure. The product barrier is slidably mounted in relation to the support wherein the product barrier comprises first and second members which are vertically arranged, one above the other, and which are movable in relation to each other and which cooperate in one position or orientation to retard a forward movement of an associated object supported on the first associated merchandising structure.

BRIEF DESCRIPTION OF THE DRAWINGS

The present disclosure may take physical form in certain parts and arrangements of parts, several embodiments of which will be described in detail in this specification and illustrated in the accompanying drawings which form a part hereof and wherein.

DETAILED DESCRIPTION

It should be understood that the description and drawings herein are merely illustrative and that various modifications and changes can be made in the structures disclosed without the departing from the scope of the present disclosure. It should also be appreciated that the various identified components of the product merchandising systems discussed herein are merely terms of art and that these may vary from one manufacturer to another. Such terms should not be deemed to limit the present disclosure.

Figure 1:
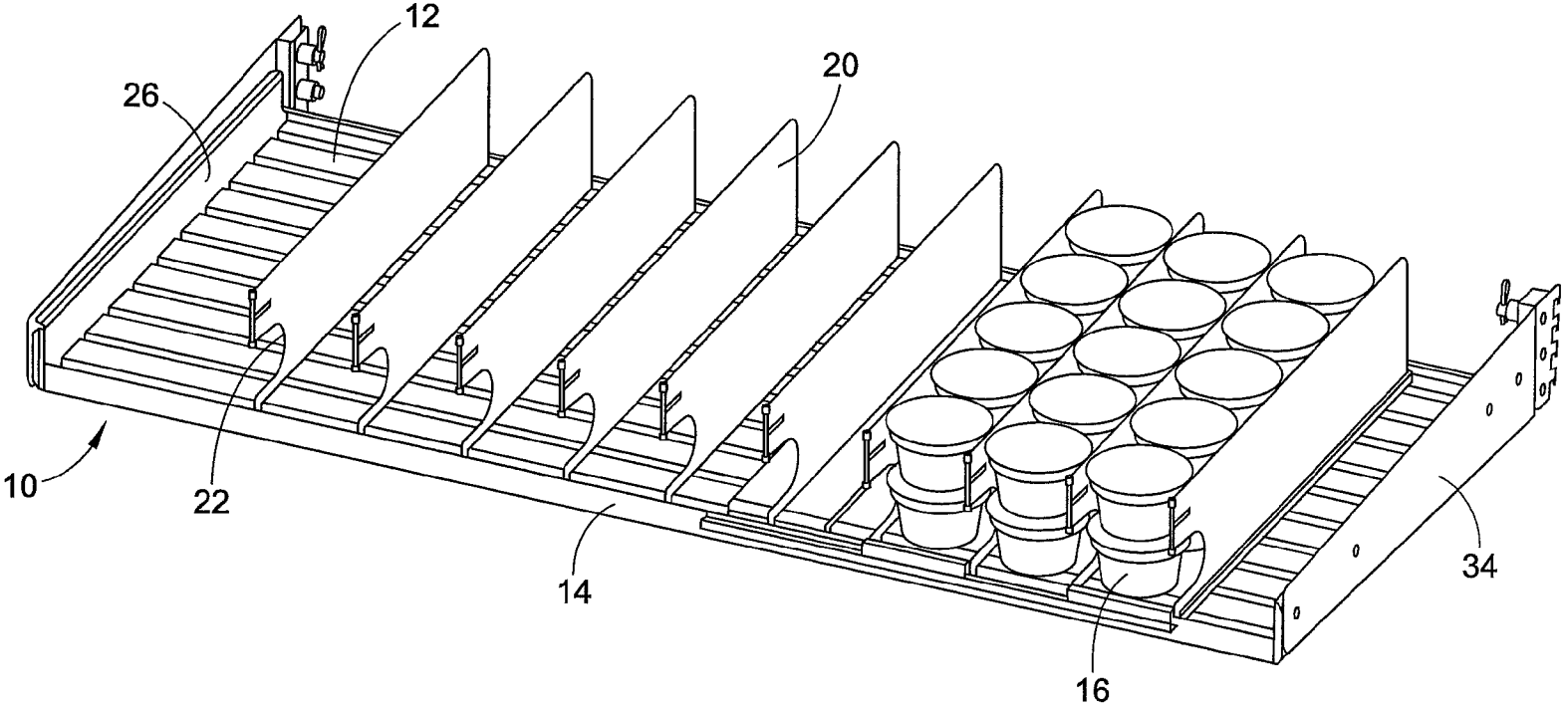
FIG. 1 is a perspective view of a shelving system according to a first embodiment of the present disclosure in a retracted position.

With reference now to FIG. 1, a first embodiment of a shelving system according to the instant disclosure includes a merchandising shelf 10. In the embodiment disclosed, the shelf includes a base 12 on which are supported a plurality of roller tracks 14. The roller tracks can be of the type disclosed in U.S. Pat. No. 6,089,385 which issued on Jul. 18, 2000 and is entitled "Roller Type Commodity Stand." The disclosure of the '385 patent is incorporated hereinto by reference in its entirety. Other means for moving the packages or containers forward on the shelf include motion mats or any known non-friction material.

Supported on the roller track 14 can be a container 16 or a stacked set of containers. The containers can be, for example, dairy product containers. It is well known that such containers can hold sour cream, cottage cheese, yogurt, cream cheese and the like. The containers generally have planar bottom and top surfaces so that they can be stacked atop each other as is illustrated in FIG. 1. A gravity fed system is illustrated in which the containers will move towards the front end of the shelf because the front end is located at a lower elevation than the rear end of the shelf. Not very visible in FIG. 1 is a front barrier which prevents the container 16 from falling off the front end of the shelf. Such a barrier can be a conventional fence, as is known in the art.

Separating the several containers 16 into columns are respective dividers 20. The dividers can be mounted either to the roller tracks 14 or directly to the shelf base 12, depending on the design of the roller tracks and of the shelf base. It should be appreciated that the dividers 20 are of sufficient height so as to divide a stacked set of containers into columns. Located at a front end of each divider is a cutout 22. The purpose for the cutout is to allow finger access by a customer in order to grasp a container which the customer wishes to remove from the shelf. Also, the cutout serves to provide increased visibility to product labels.

Figure 2:
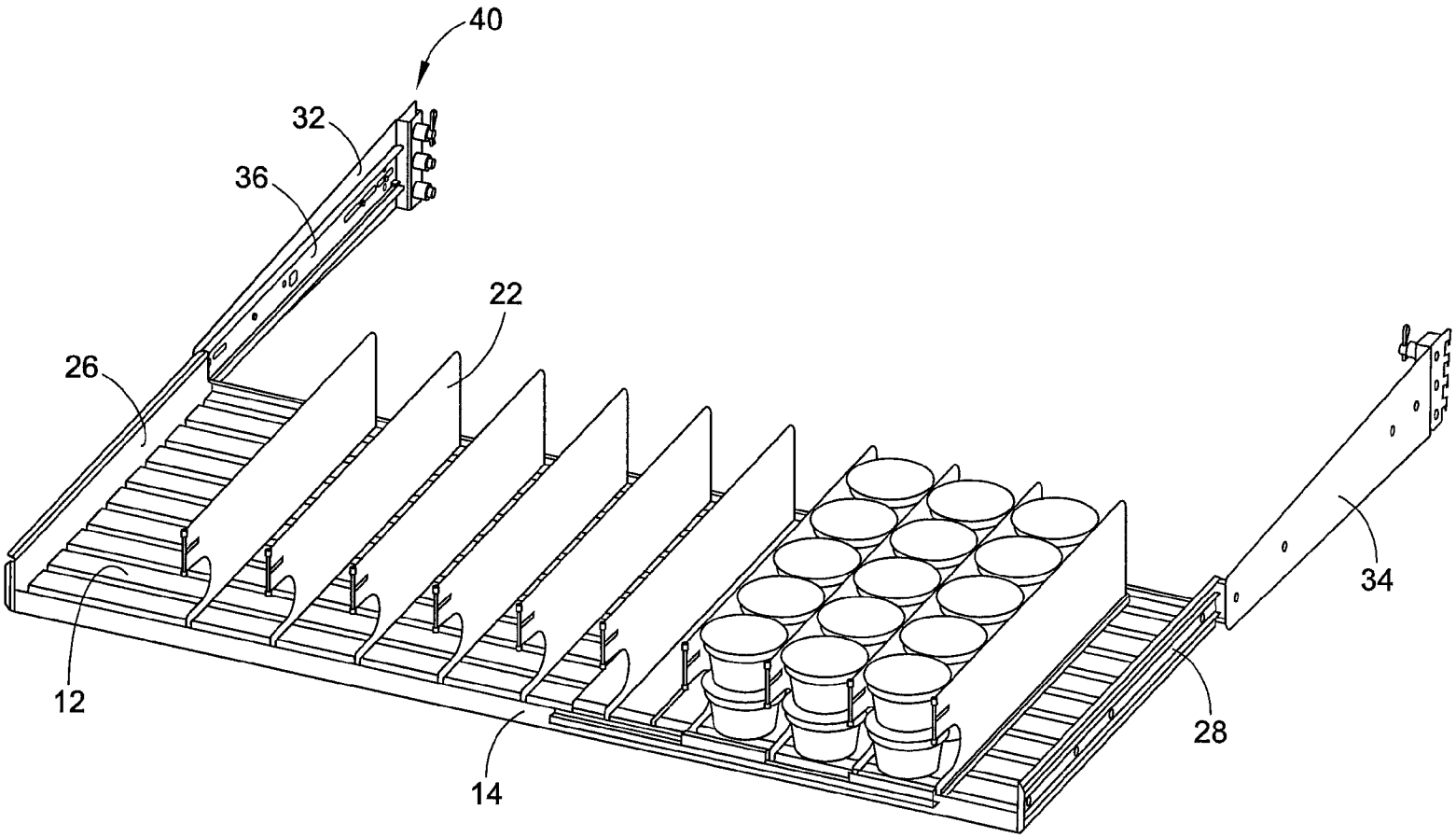
FIG. 2 is a perspective view of the shelving system of FIG. 1 shown in an extended position.
Figure 5:
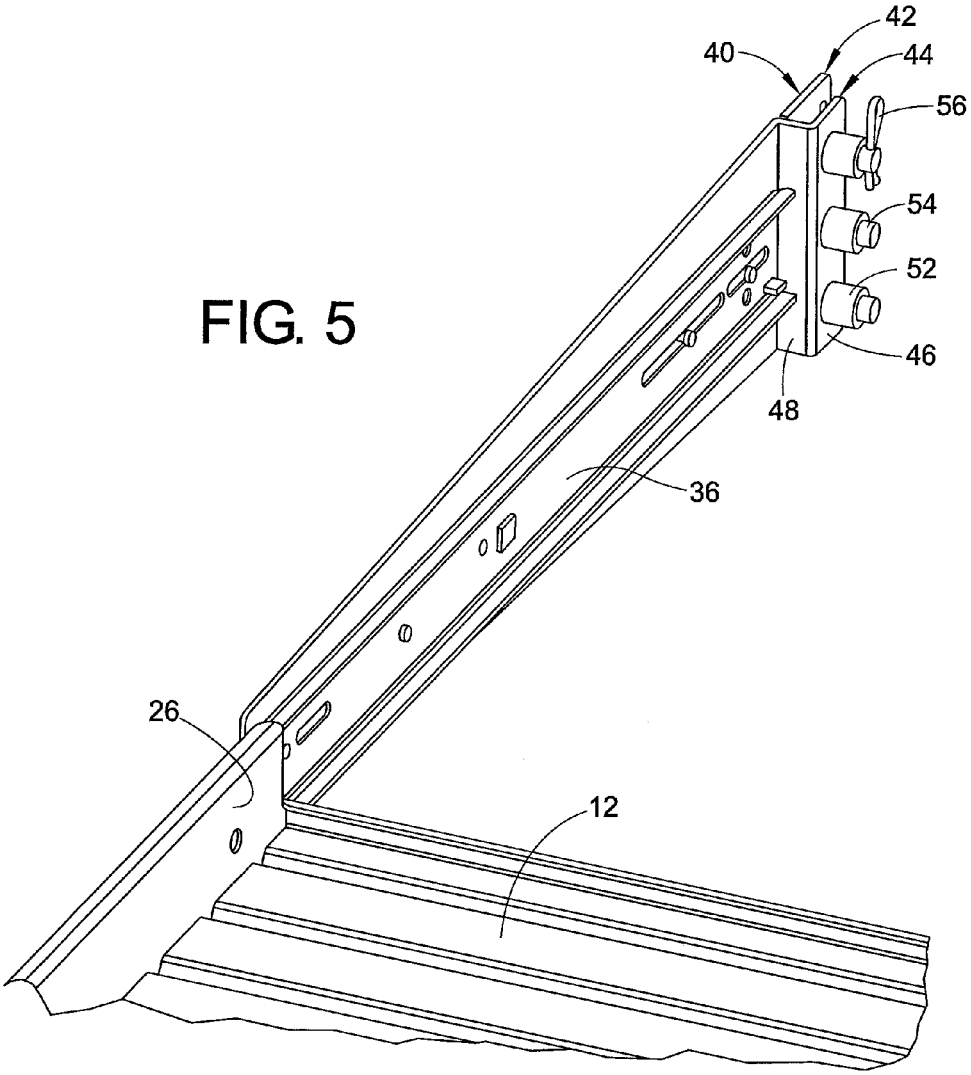
FIG. 5 is a greatly enlarged perspective view of a portion of the shelving system of FIG. 2.
Figure 12:
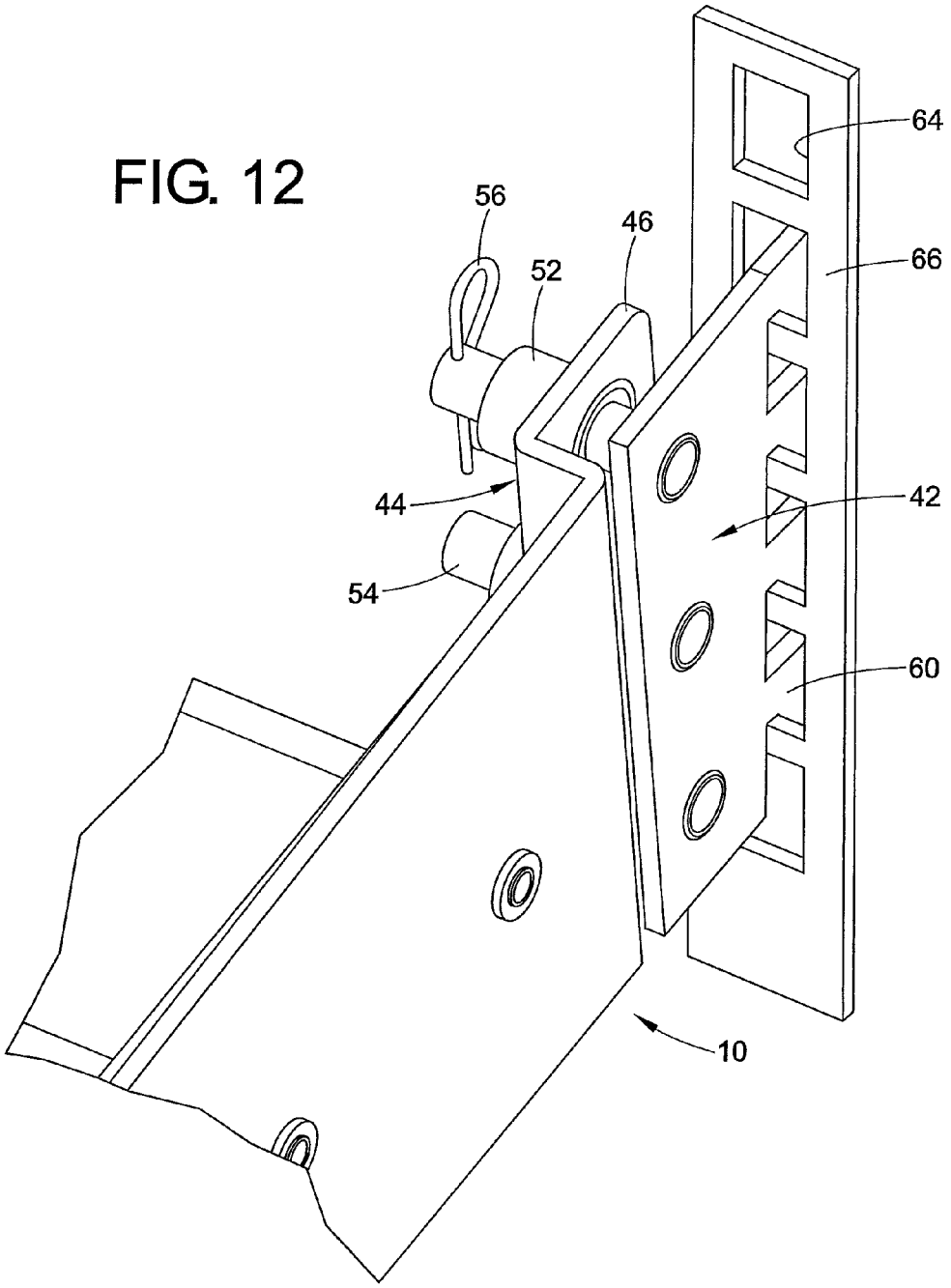
FIG. 12 is an enlarged perspective view of a mounting portion of the shelving system illustrated in FIG. 1.

With reference now also to FIG. 2, it can be appreciated that the shelf 10 is of a pull out nature. To this end, the shelf includes a pair of side walls 26 and 28 attached or connected to the base wall 12. The shelf, via the side walls 26 and 28, is slidably mounted in respective first and second brackets 32 and 34 of the shelving assembly. To this end, respective slides 36 (only one of which is visible in FIG. 2) are provided. Located at a rear end of the respective brackets is a mounting portion 40. Since the two mounting portions are mirror images of each other, only one of the mounting portions will be discussed in detail herein. With reference now to FIGS. 5 and 12, the mounting portion 40 includes a first member 42 and spaced therefrom and extending generally parallel thereto a second member 44. The second member 44 is integral with the bracket and includes a first wall 46 as well as a connecting wall 48 for connecting the first wall to the remainder of the bracket. A somewhat L-shaped design is disclosed for the second member. Mounted on the first wall 46 is at least one sleeve 52. In this embodiment, three such sleeves are shown in a vertically spaced alignment. Slidably mounted in each sleeve 52 is a pin or connecting member 54 which is fastened to the first member 42. Extending through the pin 54 is an aperture (not visible) which can selectively accommodate a cotter pin 56 to hold the pin in place in the sleeve 52.

Figure 8:
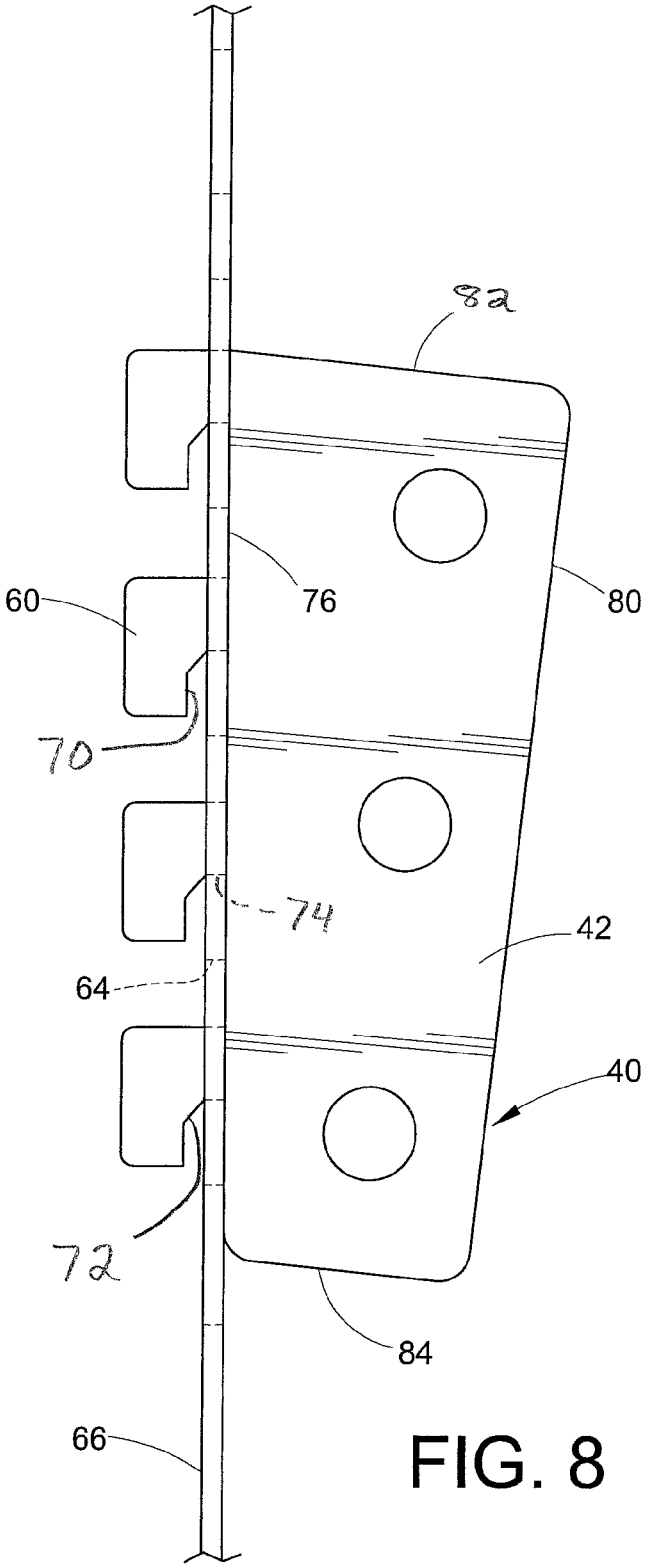
FIG. 8 is a greatly enlarged side elevational view of a bracket of the shelving system of FIG. 1 as mounted on a support.
Figure 9:
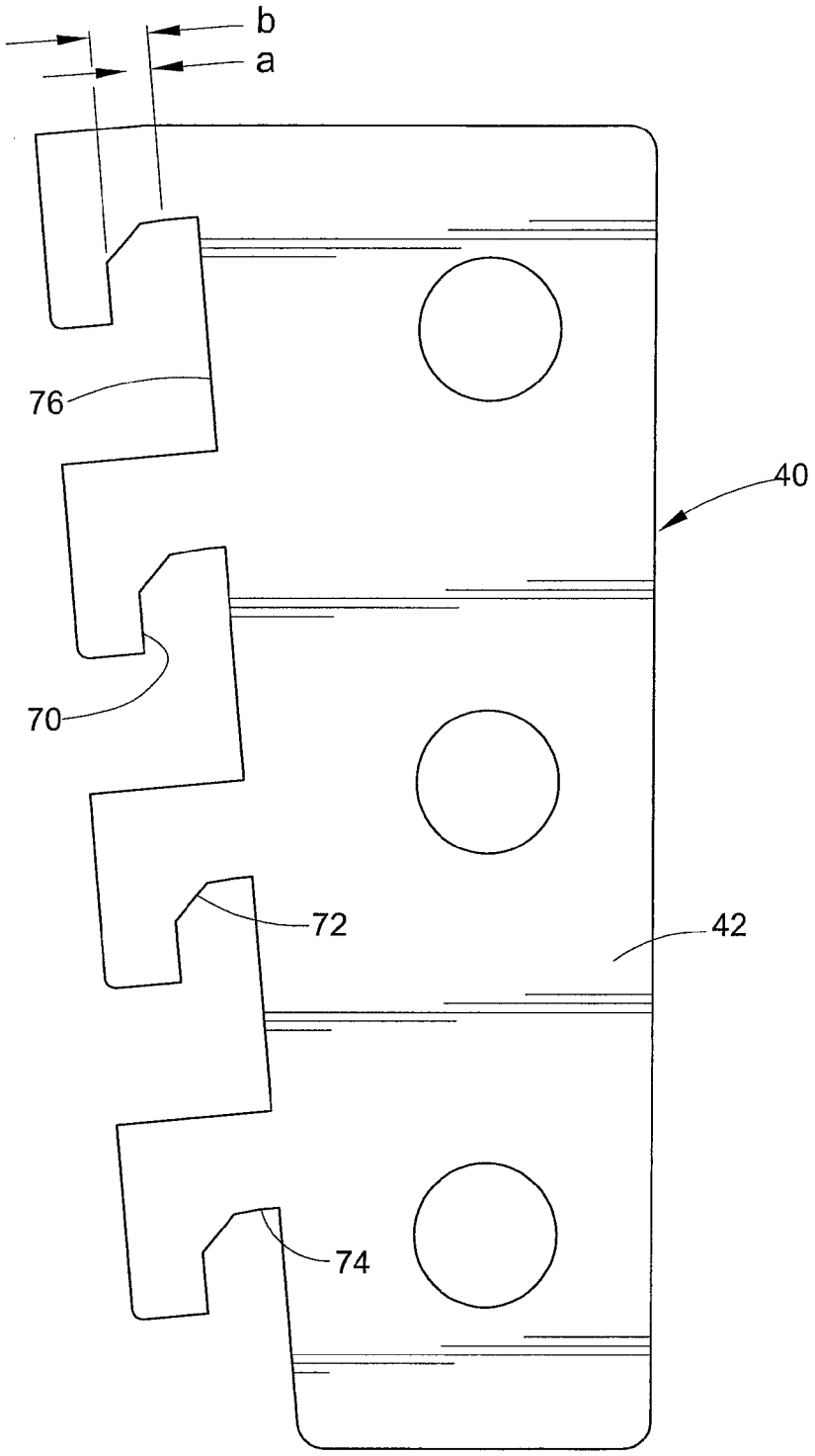
FIG. 9 is an enlarged side elevational view of a bracket of FIG. 8.

With reference now to FIG. 8, the mounting portion 40 includes a plurality of vertically spaced teeth 60 which are designed to protrude through respective apertures 64 defined in a support, standard or stanchion 66 as is well known in the art. There are a number of support manufacturers which each have a somewhat different design for their respective supports. With reference now to FIG. 9, the instant mounting portion is meant to accommodate the support or stanchion designs of several such manufacturers. To this end, the plurality of teeth 60 each include a first wall section 70, a second wall section 72 and a third wall section 74. The wall sections are so oriented that the first section 70 extends generally vertically and is aligned with and spaced from a rear wall 76 of the mounting portion. The second section 72 is oriented at an angle of approximately 45 degrees to the orientation of the first wall section 70. The third wall section 74 is oriented generally perpendicular to the first wall section 70. In this way, a support material width of a (about 0.08 inches) is accommodated by the third wall section 74, whereas a width of b (about 0.180 inches) can be accommodated between the first wall section 70 and the rear wall of the bracket 76. Thus, varying thicknesses of material in the supports or stanchions of the several manufacturers can be accommodated by the mounting portion 40 disclosed herein.

With this arrangement, and with reference again to FIG. 12, the first member 42 can be mounted to the support or standard 66 and the shelf 10 is slid onto the first member 42 via the interengagement of the several pins 54 with the sleeves 52. The shelf is held in place on the first member by use of the cotter pins 56. In one embodiment, three sleeves 52 and three pins 54 are employed. Of course, a variety of other designs is also contemplated.

Figure 10:
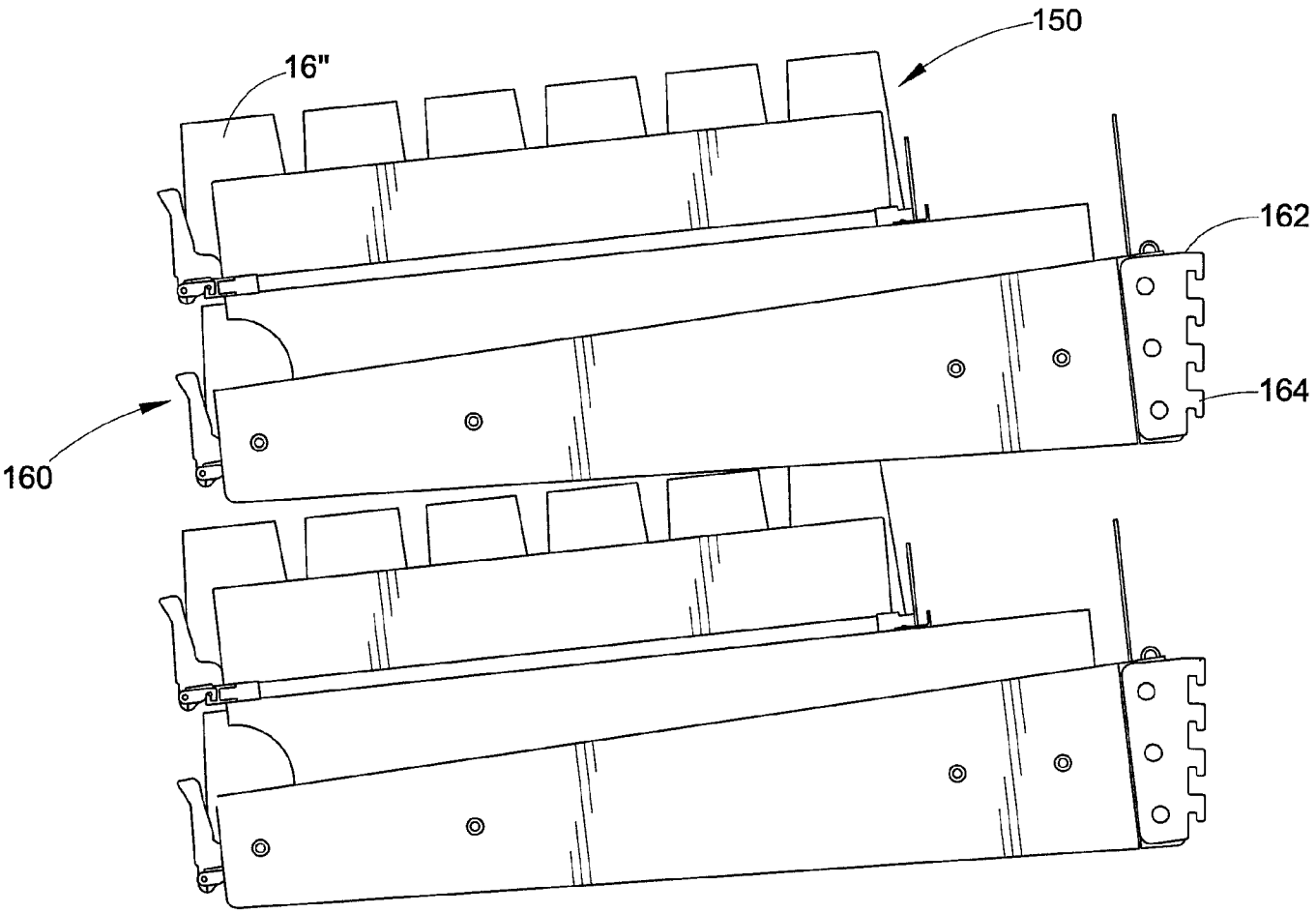
FIG. 10 is a side elevational view of a shelving system employing a variant of the second embodiment illustrated in FIG. 3.

With reference now again to FIG. 8, in addition to the back wall 76, the mounting portion also includes a front wall 80, a top wall 82 and a bottom wall 84. It can be seen that the top wall 82 is wider than is the bottom wall 84 so that the mounting portion 40 is angled downwardly somewhat in relation to a horizontal plane. As a result, so is the shelf attached to the mounting portion. As best seen in FIG. 10, the shelving arrangement angles downwardly so as to provide a gravity feed to the containers held on the shelf.

The stanchions of various manufacturers, such as Hussman, Hill-Phoenix and Kysor-Warren vary somewhat, not only in the thickness of the metal used in the supports or stanchions or uprights, but also in the longitudinal spacing between an adjacent pair of such supports to which a shelf is mounted. In order to accommodate such spacing variations, the instant shelving assembly provides a design in which the mounting portion 40 includes the first member 42 which holds the several pins 54 and a second member 44 defined by the wall sections 46 and 48, which hold the sleeves or collars 52 held on the wall section 46. As best seen in FIG. 12, the pins 54 protrude through the sleeves 52 and are held in place via the cotter pins 56. See also FIG. 5. Variations in the spacing between adjacent supports can be accommodated by suitable movement of the second member 44 in relation to the first member 42. The shelf 10 can thus be employed with the supports of a variety of manufacturers making the disclosed shelf design nearly universal.

Figure 6:
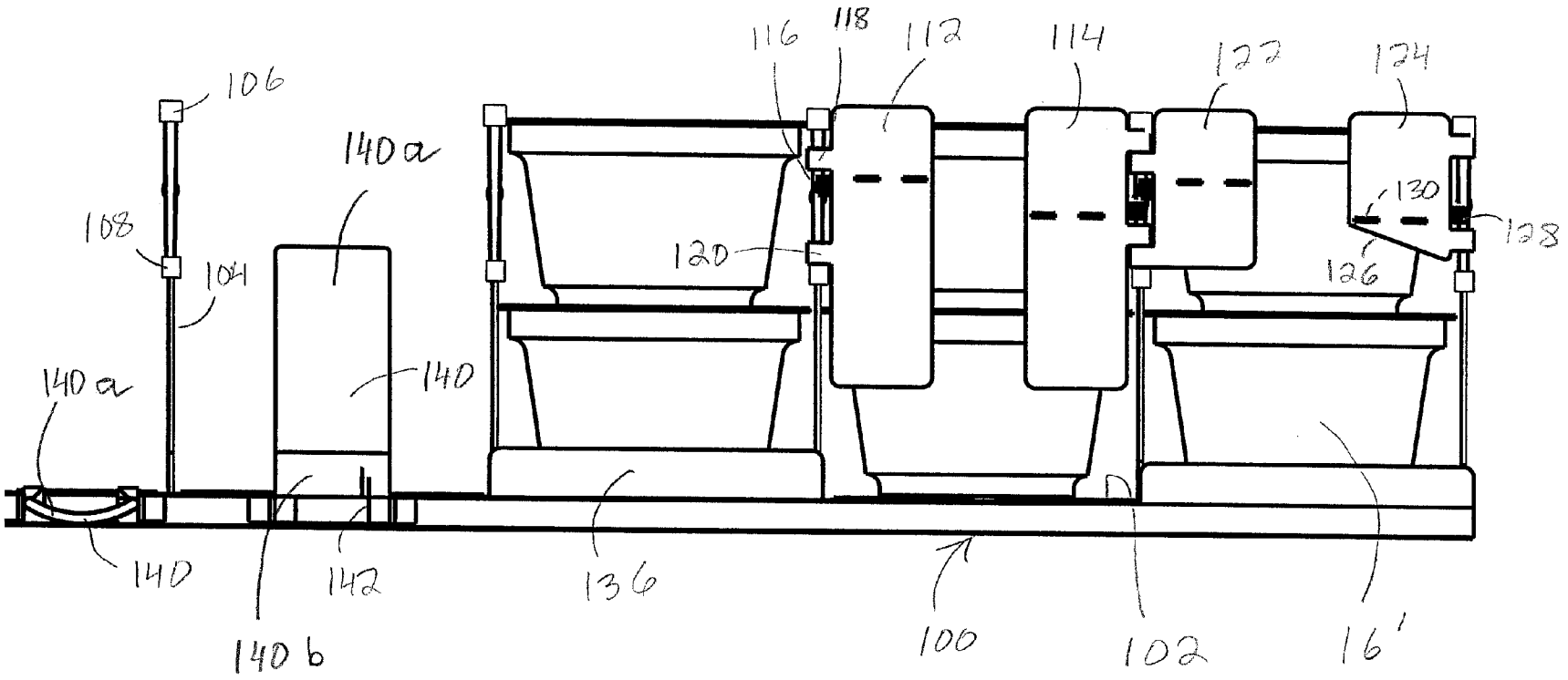
FIG. 6 is a front elevational view of a portion of a shelving system according to a third embodiment of the present disclosure.

With reference now to FIG. 6, another shelf 100 is there illustrated. The shelf includes a base 102 which supports a plurality of spaced dividers 104. In this embodiment, each divider includes a first protrusion 106 which can be located on the upper end of the divider and a second protrusion 108 which is spaced from the first protrusion. This embodiment employs barriers. More specifically, first and second barriers 112 and 114 are mounted to respective dividers. The barriers are spring loaded, such as by a spring 116, which can be a coil spring, to a neutral position. In order to mount the barriers to the dividers, the barriers are each provided with an upper arm 118 and a lower arm 120. These arms are connected to the dividers and positioned between the first and second protrusions 106 and 108 on the dividers. In their neutral orientation, the barriers serve to prevent further forward movement of containers 16' on the gravity fed shelf. In the embodiment illustrated in FIG. 6, the barriers can pivot forward and back in the same manner as café type doors or saloon doors. It should be appreciated that the first and second barriers 112 and 114 cooperate to retard the forward movement of a stacked set of containers 16'. In other words, multiple containers, one atop another, are prevented from moving forward by the cooperating barriers 112 and 114. Put another way, the height of the barriers 112 and 114 is greater than the height of a container 16'. In the design illustrated, the adjacent edges of the barriers or doors are spaced from one another, but they could be close to one another in the neutral position. The barriers can be made of a transparent material so that information on the container would be visible to purchasers.

In another design, the barrier can be so shaped as to only extend the height of a single container, such as the barrier 122. In still another design, a single product barrier, such as at 124, can include a tapered lower surface 126. This allows a consumer to more easily grasp the container 16' by allowing the fingers of the consumer to contact the container without blockage by the barrier. As with the earlier barrier designs, the barrier 124 is biased to a neutral position by a spring 128. The spring 128 can include a leg 130 illustrated in dashed outlines, which can extend along a back side of the barrier.

In still another design, a short front fence 136 can be employed to block further forward movement of a lowermost container 16'. In a yet further embodiment, a pivoting barrier 140, biased by a spring 142 to an upright position, is illustrated. The barrier 140 can include a curved body portion 140*a* and a carriage 140*b* on which the body portion is supported. To the far left of FIG. 6 is an illustration of the pivoting barrier 140 in a forwardly pivoted orientation, so as to allow removal of container 16' from the shelf 100.

Figure 7:
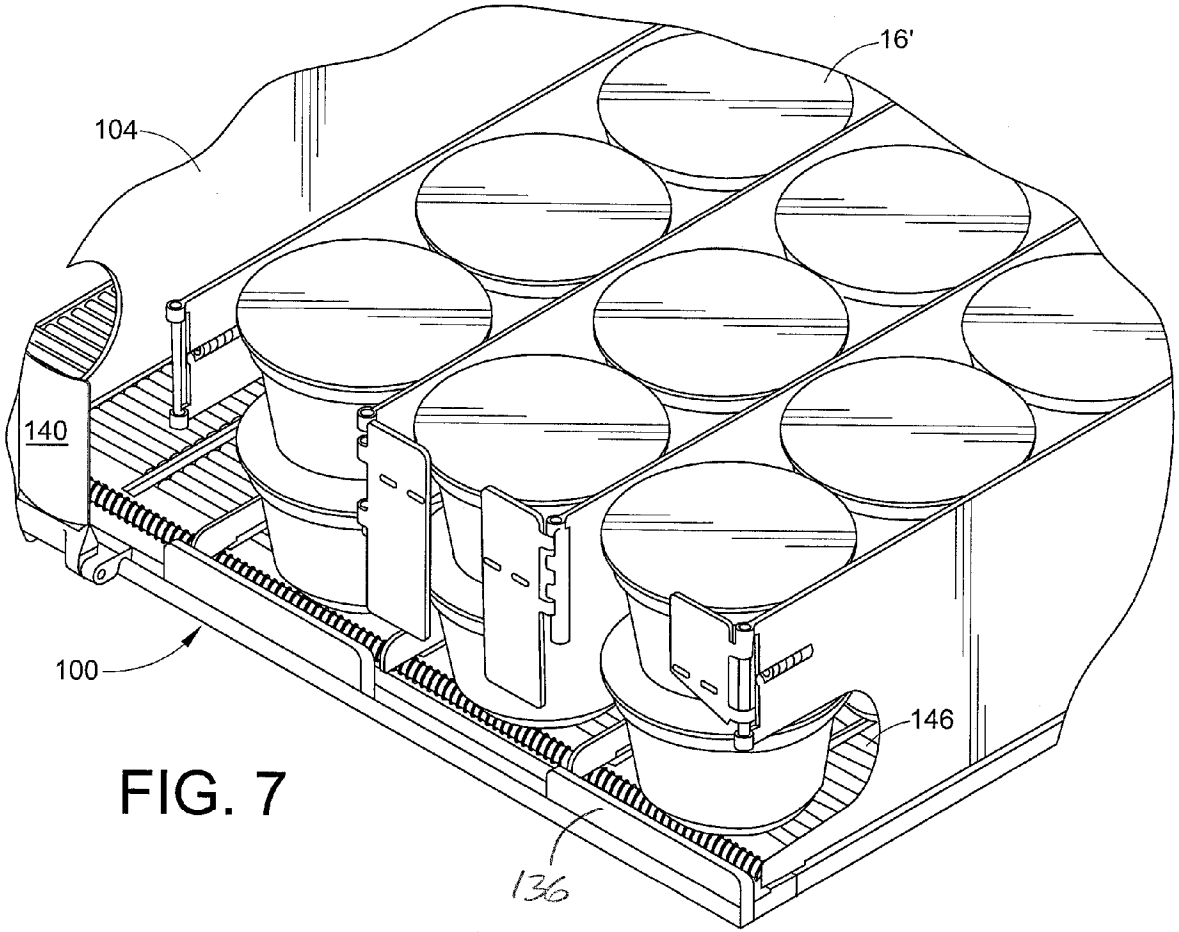
FIG. 7 is a perspective view of a portion of the shelving system of FIG. 6.

FIG. 7 illustrates that the divider 104 can include a slot 146 along its front face. The slot serves to accommodate the fingers of a consumer who wishes to withdraw a container 16' from the shelf 100. When barriers are employed only for an upper column of products, such as on the far right in FIG. 7, then a short front fence 136 becomes useful to retard a lower container 16' from falling off the shelf 100.

With reference now to FIG. 10, disclosed therein is a shelving design in which an auxiliary shelf 150 is mounted on a support shelf 160 that is connected to uprights or standards by a mounting portion 162 including teeth 164. It can be seen that the auxiliary shelf 150 is somewhat shorter than the main shelf 160. While less product can be held on the auxiliary shelf than on the main shelf, the auxiliary shelf is nevertheless advantageous from the standpoint that it can be easily connected to the main shelf or disconnected therefrom as may be necessary. In this way, a merchant can nest more product in the same amount of space without having to remove and reinstall all the shelving for a particular product category.

Figure 11:
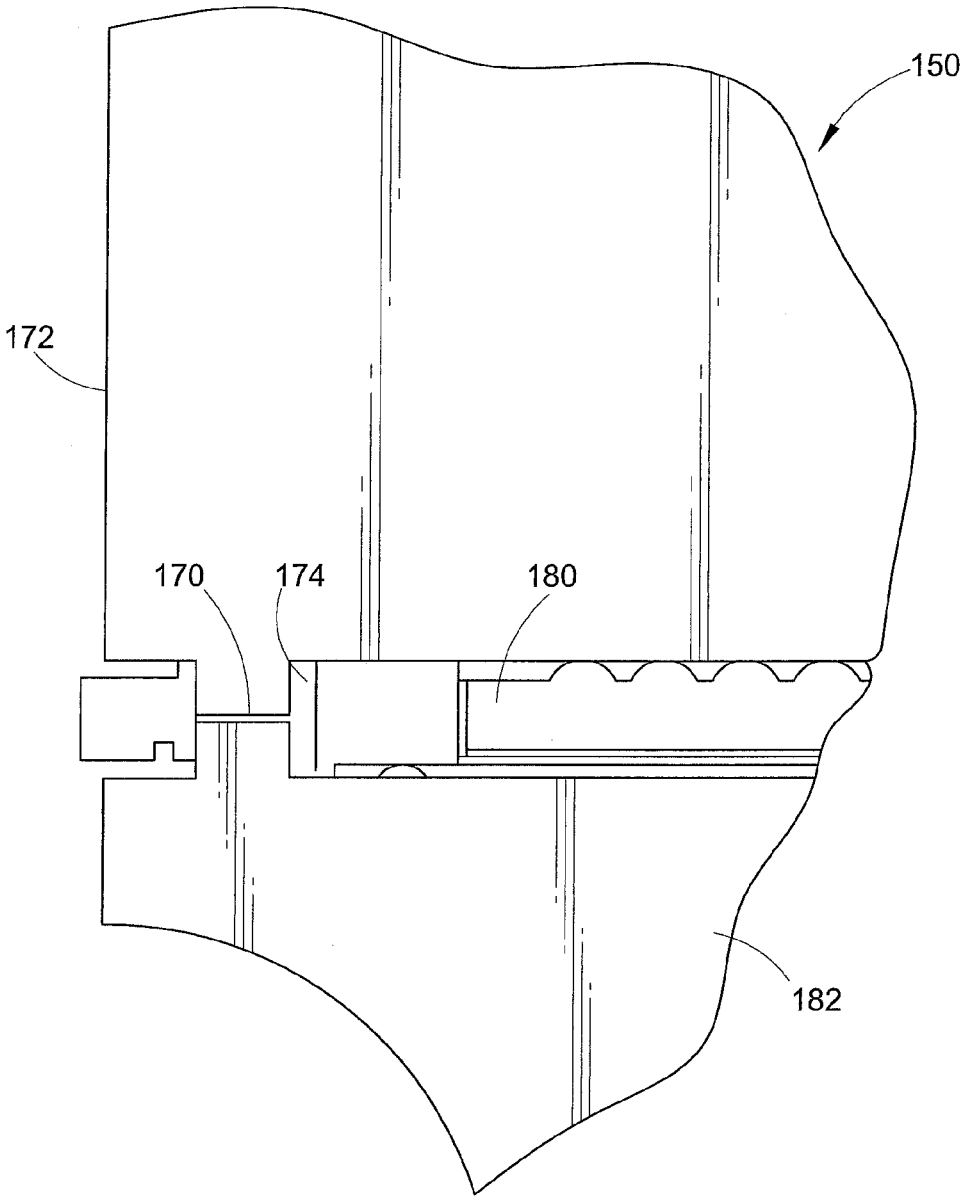
FIG. 11 is a schematic side elevational view of a portion of the shelving system of FIG. 10.

With reference now to FIG. 11, the auxiliary shelf 150 can be mounted via tabs 170 which protrude from a top divider 172. In one embodiment, such tabs extend into a slot 174 which can be provided in a housing of a roller system 180. The roller system can be of the same type as the roller track 14 discussed above. The slots can be provided on or adjacent to side edges of the roller system or roller track housing. Such slots can extend through the roller track housing so as to be accessible from both a top surface and a bottom surface of the track.

Figure 3:
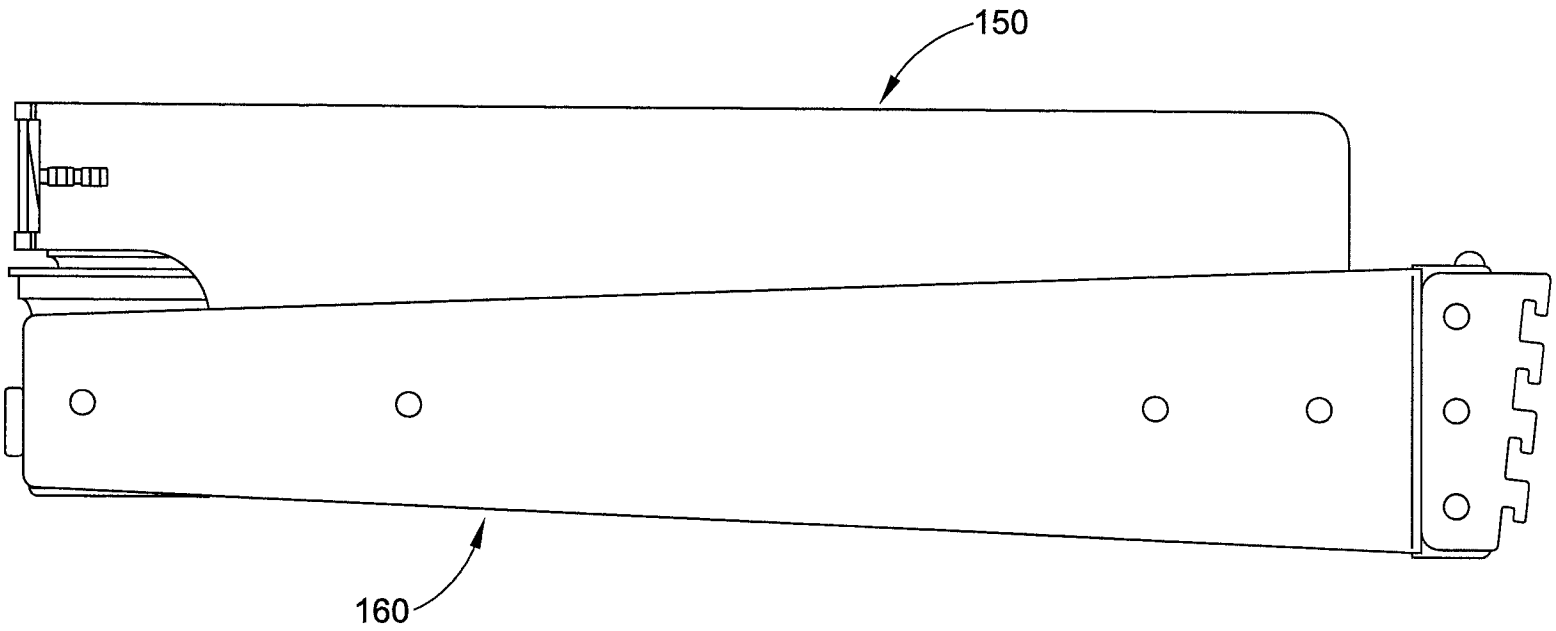
FIG. 3 is a side elevational view of a shelving system according to a second embodiment of the present disclosure in a retracted position.
Figure 4:
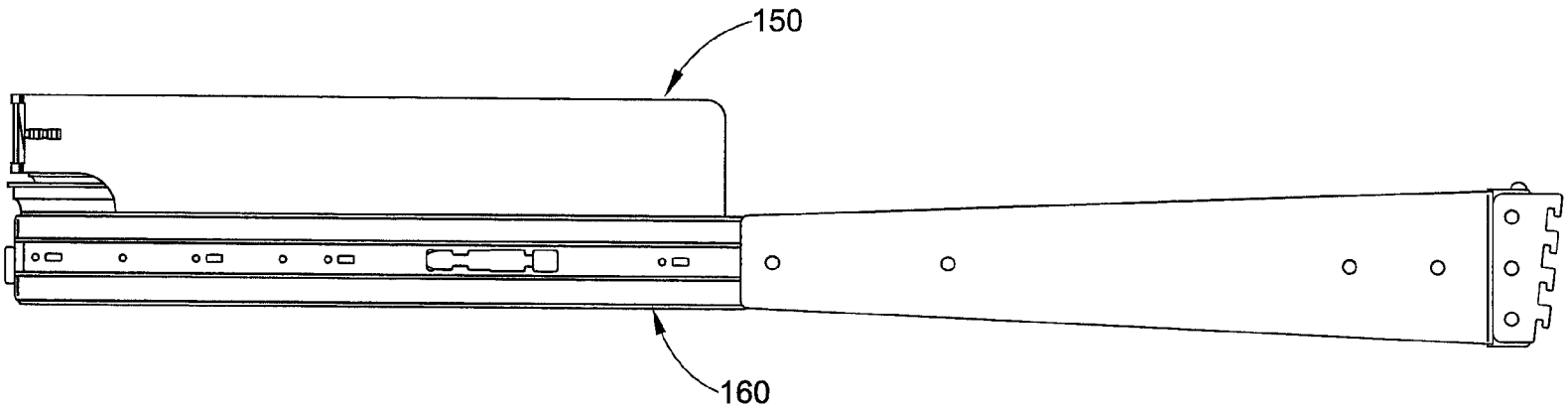
FIG. 4 is a side elevational view of the shelving system of FIG. 3 in an extended position.

The roller system 180 is mounted on a bottom divider 182, also having tabs, via the slots 174. Thus, the auxiliary shelf 150 is comprised of the roller system 180 and respective top dividers 172 located on either side of the roller system 180. One embodiment of this design is also evident from FIGS. 3 and 4.

Figure 13:
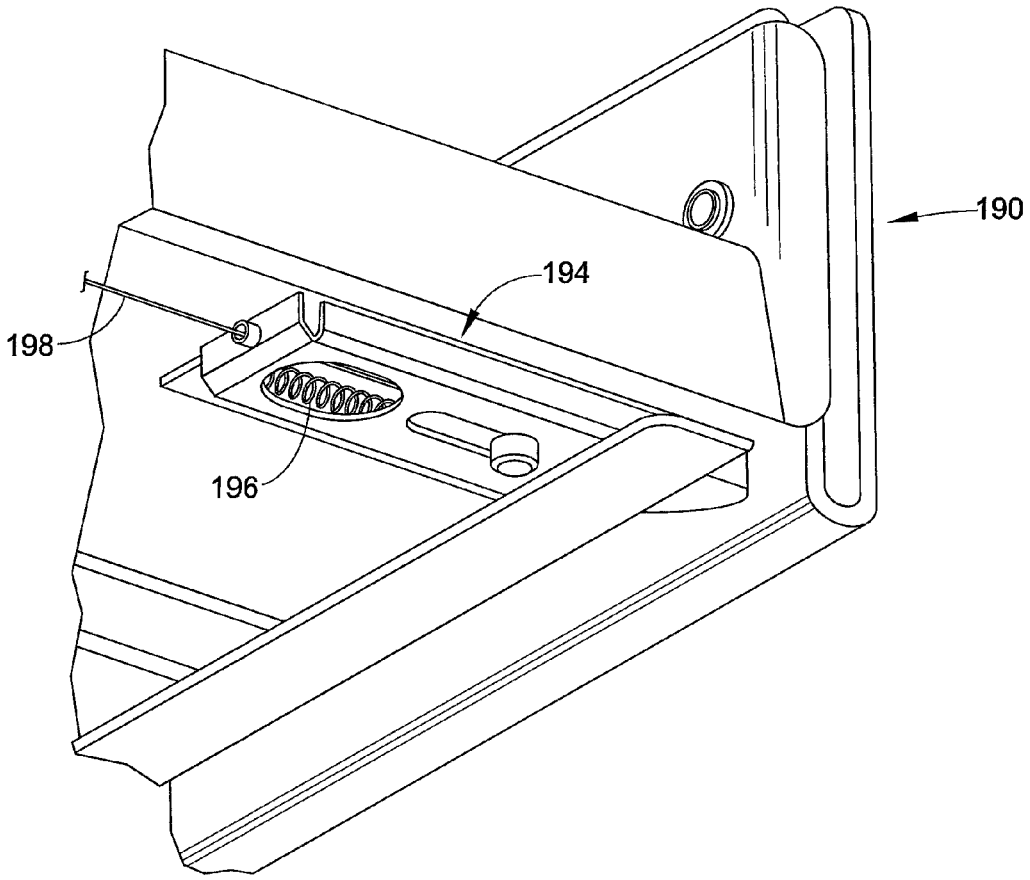
FIG. 13 is a perspective view of a latch system for shelving according to a further embodiment of the present disclosure.

With reference now to FIG. 13, a latch system can be provided for one or more of the types of shelving disclosed herein. In the embodiment illustrated in FIGS. 13-15, a shelf 190 is provided with a latch system 192 (FIG. 15). The latch system includes a latch member 194 which can be positioned adjacent both side edges of the shelf. The respective latch is located adjacent the shelf side wall. As evident from FIG. 13, the latch can be spring biased by a spring 196. It is evident from FIG. 15 that the two latch members 194 are connected via a cable 198 so that they act in unison unlatching the shelf at the same time.

Figure 14:
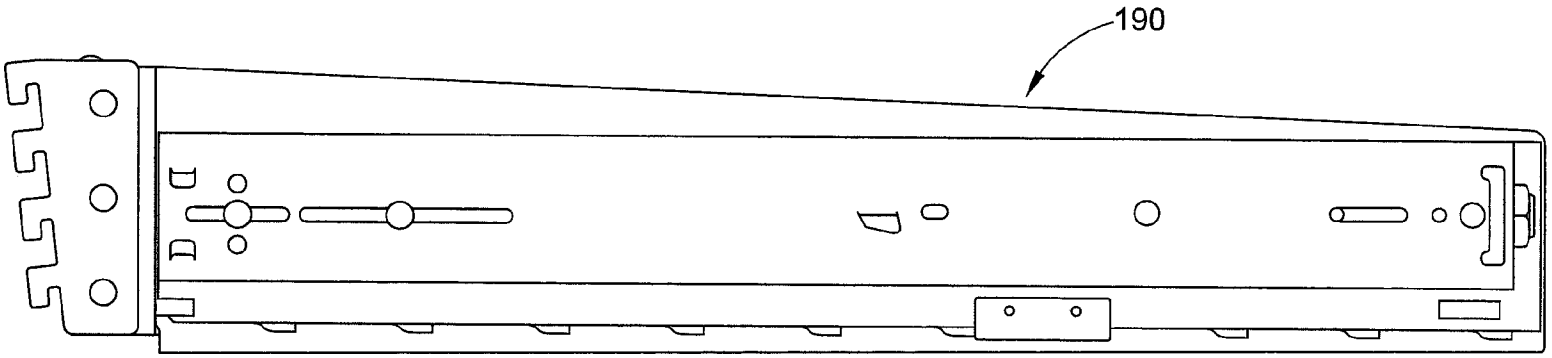
FIG. 14 is a side elevational view of the latch system of FIG. 13.
Figure 15:
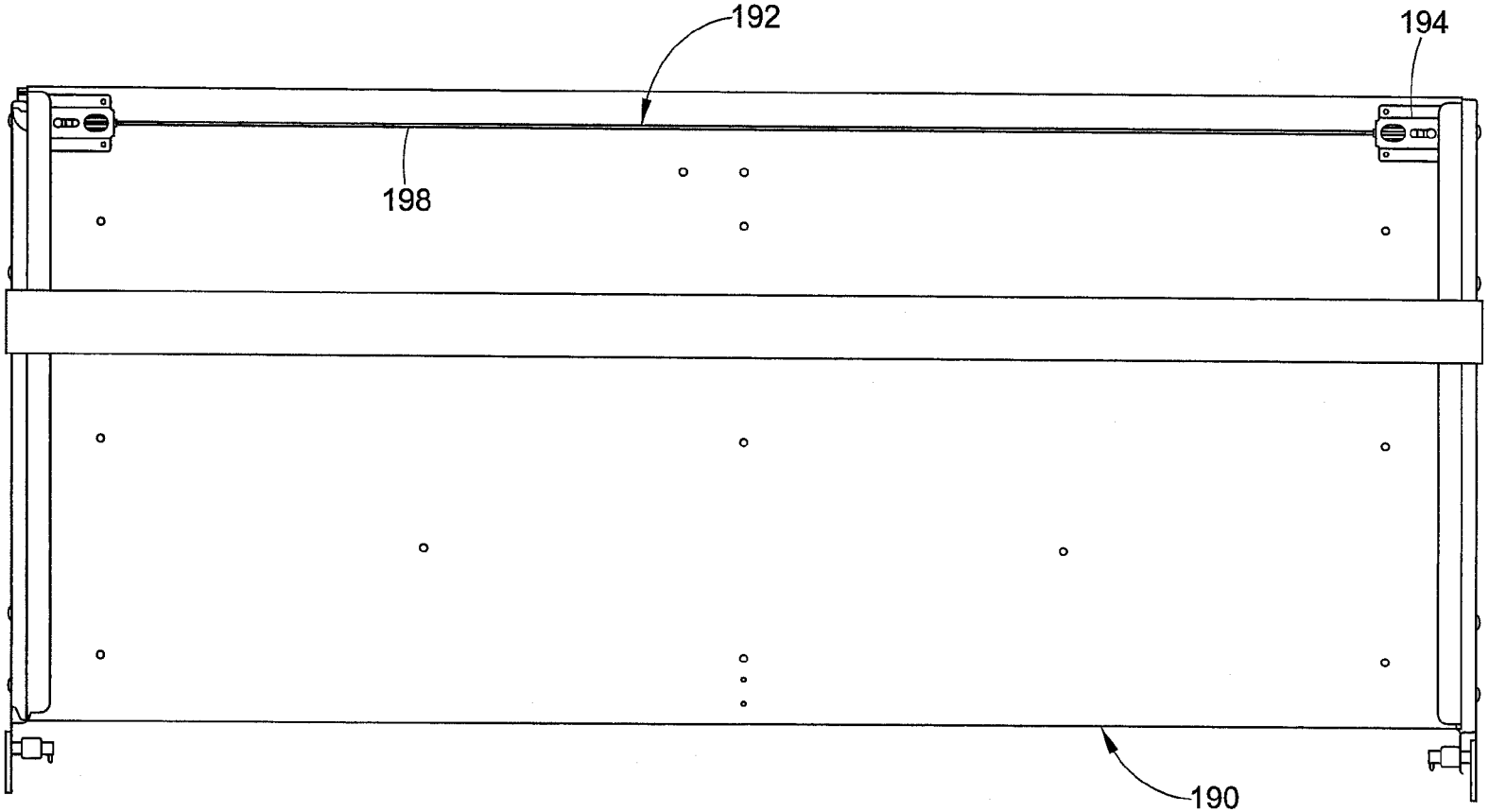
FIG. 15 is a bottom plan view of the latch system of FIG. 13.

With reference now to FIG. 14, the latch mechanism can be provided either adjacent the front end or the rear end of the shelf. It is contemplated that moving the latch towards the rear end of the shelf, i.e., towards the uprights, may be advantageous. An operator would hold the cable or the safety latch in order to slide the shelf forward to a product load configuration. The spring loaded safety latch would engage slots in the first and second brackets to allow the shelf to be slid out from a use configuration to a restocking configuration. When the shelf has been restocked, it is simply pushed back and the spring bias of the latches will again reengage the shelf with the brackets to maintain the shelf in a use configuration.

The product merchandiser embodiments illustrated herein allow shelving to be stacked closely together as withdrawal of the containers does not involve much upward movement of the containers to clear a barrier. Instead, the containers can be simply withdrawn in a generally horizontal direction. In addition, the provision of auxiliary shelves allows the product density for the merchant to be increased significantly. This is very desirable, as more products can be displayed by the merchant in the same amount of space without having to remove and reinstall shelves.

Further, the product merchandiser designs illustrated herein allow shelving to accommodate the uprights or standards of a variety of manufacturers, thereby enabling the disclosed shelving to be almost universal in nature.

In addition, another benefit of the disclosed shelving designs is that slide out shelving is provided in which the orientation of the shelf does not change during the sliding out procedure so that product held on the back end or inner end of the shelf does not hit or contact the shelf immediately above the one which is being slid forwardly.

A latch system is disclosed herein which enables the slide out shelf to be held in a use configuration. The latch system can be selectively disengaged to allow the shelf to move into a restocking configuration on slides defined between side walls of the shelf and brackets mounting the shelf to supports or uprights of the store fixtures.

Figure 16:
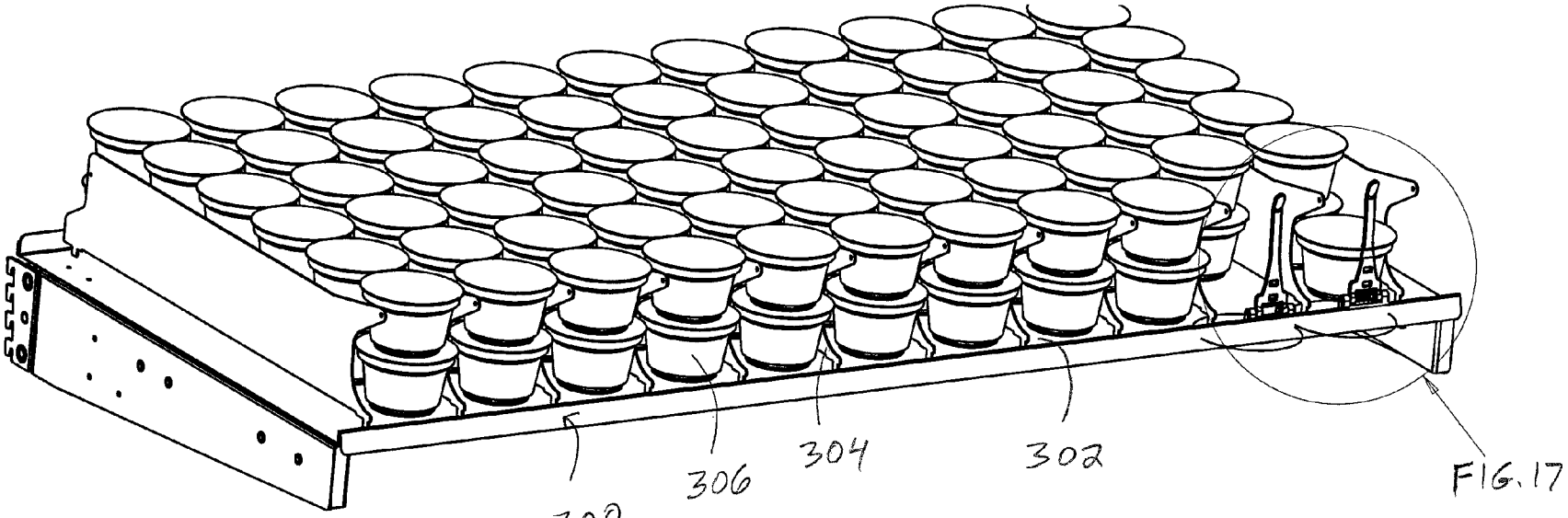
FIG. 16 is a perspective view of another embodiment of a shelving system according to the present disclosure.
Figure 17:
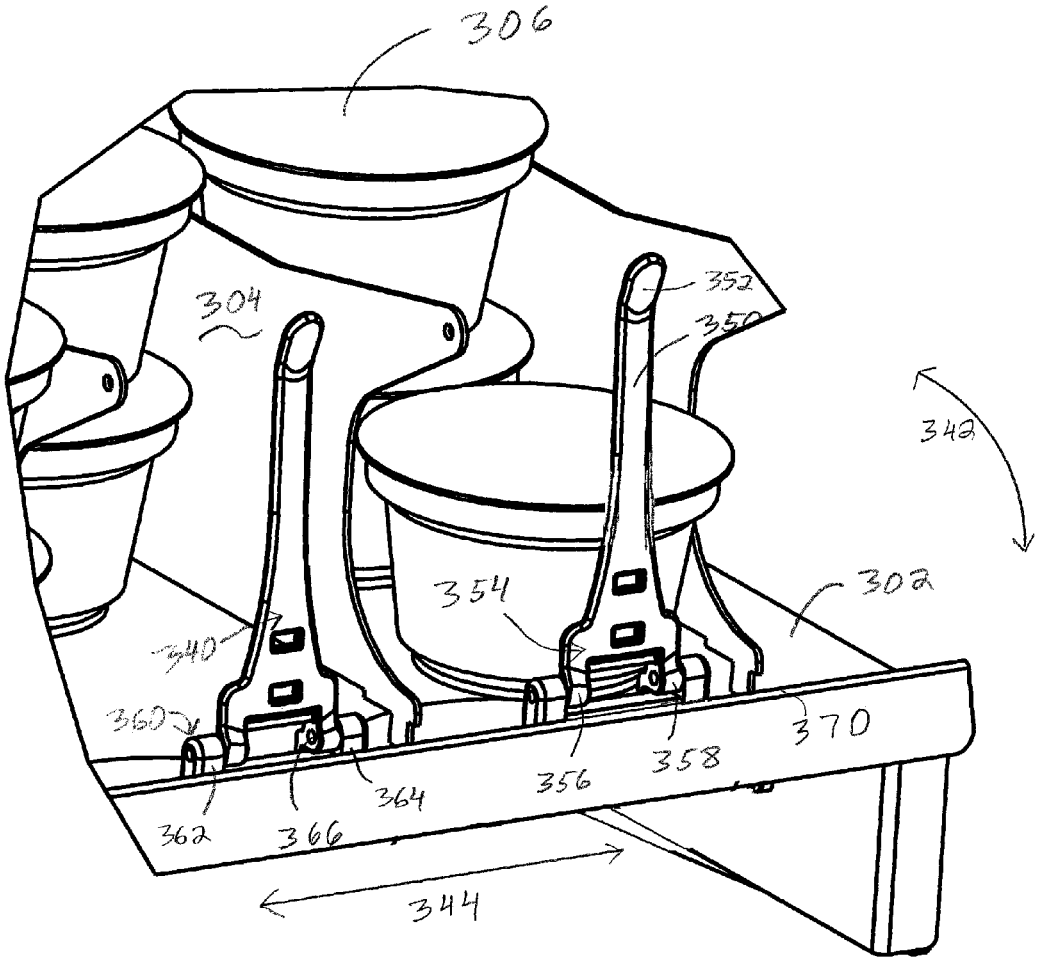
FIG. 17 is an enlarged perspective view of a portion of the shelving system of FIG. 16.

With reference now to FIG. 16, a shelf 300 includes a shelf base 302 which supports a plurality of dividers 304. The dividers are employed to separate product containers 306 into respective columns. In this embodiment, the product containers are in a stacked arrangement. While any number of containers can be stacked, illustrated is a double stack arrangement. With reference now also to FIG. 17, the product containers 306 are advanced forwardly on the shelf via either a gravity feed system or a known pusher assembly. In either case, a barrier is provided at the front end of the shelf so as to retard product containers from falling off the shelf.

In this embodiment, a pivoting and sliding barrier system is illustrated. More particularly, barriers 340 are rotatable in relation to the shelf along arrow 342 and are also slidable in relation to the shelf along arrow 344. The barrier 340 includes an elongated body 350 in the shape of an arm and terminating in a tip 352, which may extend out of the plane of the arm, as well as a mounting portion 354. The mounting portion can be wider than is a width of the arm 350 and can include a first finger 356 and second finger 358. The mounting portion 354 is connected to a carriage 360. More particularly, the mounting portion first finger 356 engages a first arm 362 of the carriage while the mounting portion second finger 358 engages a carriage second arm 364. The engagement of each mounting portion finger with a respective carriage arm can be resiliently biased, via a suitable biasing member 366 (for example a spring), so that the barrier 340 is biased towards the upright position illustrated in FIG. 17. The carriage 360 can slide sideways on rail 370 when pushed in either of the two directions of arrow 344 by a customer.

While one particular embodiment of an arm is illustrated in FIGS. 16 and 17, it should be appreciated that narrower and wider arm versions can be employed depending on the width of the product being stocked by the merchant.

Preferably, there is a friction fit between the rail 370 and the carriage 360 so that the product barrier 340 does not move laterally when incidentally contacted by a potential customer. One advantage offered by the slidable barrier system disclosed herein is that the barrier is infinitely adjustable so as to accommodate a desired number of columns of product or product containers held or supported on the shelf 302. To this end, additional barrier systems 340 can be mounted on the rail 370 to accommodate relatively narrow columns of products or containers and barrier systems can be removed when relatively wide columns of products or containers on the shelf require fewer barrier systems mounted on the rail.

Also, the barrier 340 can be pivoted forwardly along the direction of arrow 342 so that a product container 306 can be removed from the shelf 300. To this end, a customer would grasp the tip 352 of the barrier 340, which is adapted for this purpose, as it extends away from the plane of the body 350, and pull the barrier forward against the urging of the biasing member in order to access the product container held behind the barrier. Needless to say, the strength of the bias provided by the one or more biasing members 366 has to be adjusted so that when the barrier 340 is in the upright position it will retard or prevent product containers from falling off the shelf against the bias of whatever type of biasing assembly is used to feed the product containers forward on the shelf. On the other hand, the biasing member or spring 366 cannot be so strong as to make it difficult for a potential purchaser to pull on the barrier 340 in order to rotate it forward to provide access to the product containers. The carriage 360 is adapted to move along a longitudinal axis of the shelf 300, as shown by arrow 344, so as to move transversely in relation to the several columns of product containers held on the shelf when pushed by a customer. In this way, the barrier can not only be pivoted out of the way by a potential consumer of the product 306 but can also be slid or pushed out of the way along the rail 370 if so desired.

A comparison of the barrier 140 illustrated in FIGS. 6 and 7 with the barrier 340 illustrated in FIGS. 16 and 17 will show that the barrier 340 may be advantageous from the standpoint that less material is employed to form the barrier 340 than the barrier 140. Thus, the barrier 340 may be advantageous from a cost standpoint. It should also be appreciated that both the barriers 140 and 340 can be made out of a suitable transparent material so that any signage on the product containers 306 held behind the barrier is visible to a potential purchaser. To this end, the barriers 140 and 340 can be made of a suitable transparent thermoplastic material.

A variety of blocking or retaining members has been disclosed herein for use at the front end or dispensing end of a gravity fed merchandising shelf. In one design, multiple stacked containers can be deterred from forward movement. In another design, single containers in a stack are deterred from such movement.

Disclosed has been a product vending system in the form of a merchandising shelf comprising a support member for supporting at least one associated object for display and/or dispensing. The support member defines a longitudinal pathway along which the associated at least one object can travel from a rear position to a front position. The shelving system can be of a slide out nature so that the shelf can be slid forward for restocking. The shelving system is adaptable for use with the uprights or standards supplied by a variety of manufacturers. Also, the shelving system, which can be a gravity fed system, can include a movable retainer operatively connected to a front end of the shelving system. The retainer is movable from a first position which at least partially obstructs the pathway, thereby retarding forward movement of the at least one associated object beyond the front end of the shelf, to a second position allowing further forward movement of the at least one associate object for removal of same from the shelf. In one embodiment, the retainer can include a body portion which is movable in relation to the shelf. The movement can be a pivoting movement which allows access to associated product held on the shelf behind the barrier. Alternatively, the movement can be a sliding movement so that the barrier is moved transversely in relation to a column of product being held on the shelf in order to allow access to such product.

The present disclosure has been described with reference to several embodiments. Obviously, modifications and alterations will occur to others upon the reading and understanding of the preceding detailed description. It is intended that the present disclosure be construed as including all such modifications and alterations insofar as they come within the scope of the appended claims or the equivalents thereof.

What is claimed is:

1. A merchandising security system comprising:

a horizontally oriented support adapted to be secured to a first associated merchandising structure at a forward end thereof so that the support extends laterally along the forward end of the associated merchandising structure;

at least one product barrier moveably mounted atop the support, the at least one product barrier extending away from the support so as to approach a second associated merchandising structure spaced above the first associated merchandising structure;

wherein the at least one product barrier is at least one of slidably mounted in relation to the support and pivotably mounted in relation to the support wherein the at least one product barrier comprises first and second members which cooperate to retard a forward movement of an associated object supported on the first associated merchandising structure, wherein at least one of the first and second members is mounted in relation to the support via a hinge;

wherein the first member is pivotable in relation to the second member; and a biasing member for biasing the first member to one end position in relation to the second member and wherein, in the one end position, the first and second members extend in a common plane.

2. The merchandising security system of claim 1 wherein the first member pivots on a generally horizontally oriented axis in relation to the second member.

3. The merchandising security system of claim 1 wherein the first member comprises a body portion; and the second member comprises a carriage on which the body portion is supported.

4. The merchandising security system of claim 3 wherein the body portion includes an elongated upper portion and a connection portion which is wider than is a width of the upper portion.

5. The merchandising security system of claim 3 wherein the body portion comprises a generally rectangular shape.

6. The merchandising security system of claim 5 wherein the body portion is convex in a top view.

7. The merchandising security system of claim 3 further comprising a rail mounted to the support, wherein the carriage is slidably mounted to the rail.

8. The merchandising security system of claim 1 wherein the at least one product barrier is both slidably and pivotably mounted in relation to the support.

9. A merchandising security system comprising:

a support adapted to be secured to a first associated merchandising structure and extending laterally along a front edge of the first associated merchandising structure;

at least one product barrier moveably mounted to the support and adapted to retard an associated object from falling off the front edge of the first associated merchandising structure, the at least one product barrier extending away from the support so as to approach a second associated merchandising structure spaced from and located above the first associated merchandising structure;

wherein the product barrier is slidably mounted in relation to the support and is located above the support so that the product barrier is adapted to move laterally in relation to the support, wherein the product barrier comprises first and second members which are vertically arranged, one above the other, and which are movable in relation to each other, and which cooperate in one position or orientation to retard a forward movement of the associated object supported on the first associated merchandising structure;

wherein the first member is pivotable in relation to the second member; and a biasing member for biasing the first member to an upright position atop the second member and wherein, in the upright position, the first member and the second member extend in a common plane.

10. The merchandising security system of claim 9 wherein the first member pivots on a generally horizontally oriented axis in relation to the second member.

11. The merchandising security system of claim 9 wherein the first member comprises a body portion; and the second member comprises a carriage on which the body portion is supported.

12. The merchandising security system of claim 11 wherein the body portion includes an elongated upper portion and a connection portion which is wider than is a width of the upper portion.

13. The merchandising security system of claim 11 wherein the body portion comprises a generally rectangular shape.

14. The merchandising security system of claim 13 wherein the body portion is convex in a top view.

15. The merchandising security system of claim 9 wherein the product barrier is both slidably and pivotably mounted in relation to the support.

16. The merchandising security system of claim 9 wherein the biasing member comprises a spring.

17. A merchandising security system comprising:

an elongated support adapted to be secured to a first associated merchandising structure;

a product barrier movably mounted atop the support and extending upwardly therefrom, the product barrier being adapted to retard an associated object from falling off a front edge of the first associated merchandising structure, the product barrier comprising:

a first member, a second member, and a hinge connecting the first member to the second member so that the first member can pivot in relation to the second member; and a spring for biasing the first member to an end position in relation to the second member and wherein, in the end position of the first member, the first and second members extend in a common plane.

18. The merchandising security system of claim 17 wherein the product barrier is slidably mounted to the support and the first member is pivotably mounted in relation to the second member.

19. The merchandising security system of claim 17 wherein the second member comprises a carriage which is laterally slidable on the support.

20. The merchandising security system of claim 19 wherein the support comprises a rail on which the carriage is slidably mounted.

* * * * *